US007004377B2

(12) United States Patent
Metcalf

(10) Patent No.: US 7,004,377 B2
(45) Date of Patent: Feb. 28, 2006

(54) FOOD SERVING APPARATUS

(76) Inventor: Darrell J. Metcalf, 905 N. Oak Ave., Fillmore, CA (US) 93015

( * ) Notice: Subject to any disclaimer, the term of this patent is extended or adjusted under 35 U.S.C. 154(b) by 60 days.

(21) Appl. No.: 10/144,301

(22) Filed: May 13, 2002

(65) Prior Publication Data

US 2003/0211254 A1 Nov. 13, 2003

(51) Int. Cl.
*B65D 5/00* (2006.01)

(52) U.S. Cl. ..... 229/115; 229/103; 229/101.1; 229/938

(58) Field of Classification Search ..... 229/122, 229/220, 115, 107, 101.1, 101.2, 938, 101, 229/103; 426/122, 123
See application file for complete search history.

(56) References Cited

U.S. PATENT DOCUMENTS

| | | | | |
|---|---|---|---|---|
| 239,413 | A * | 3/1881 | Wilson | 229/122 |
| 422,032 | A * | 2/1890 | Munson | 229/122 |
| 1,621,451 | A * | 3/1927 | Beach | 229/101.1 |
| 2,039,830 | A * | 5/1936 | Owens | 229/101.1 |
| 4,079,853 | A * | 3/1978 | Casutt | 229/101 |
| 4,189,054 | A * | 2/1980 | Liu et al. | 220/4.23 |
| 5,110,038 | A * | 5/1992 | Pantisano et al. | 229/103 |
| 5,129,521 | A | 7/1992 | Irigoite et al. | |
| 5,181,649 | A * | 1/1993 | Frost | 229/125.125 |
| 5,476,214 | A | 12/1995 | Fisk, Jr. | |
| 5,632,379 | A * | 5/1997 | Frost | 206/541 |
| 6,230,917 | B1 * | 5/2001 | Whitnell | 220/23.87 |
| 6,299,918 | B1 * | 10/2001 | Morgese | 426/112 |
| 6,375,066 | B1 * | 4/2002 | Ritter | 229/101.2 |

* cited by examiner

*Primary Examiner*—Tri M. Mai

(57) ABSTRACT

A food serving apparatus having a flat food-supporting member consisting of a material sized to prevent served food from contacting unsanitary surfaces, and having sufficient rigidity, to support one or more food items. The food-supporting member has at least one food-retaining portion integrally formed adjacent thereto which extends upward, or can be positioned upward by a user, relative to the food-supporting member, in a manner which increases rigidity of the member. The food-supporting member has at least one bendable cross-section tangent to at least one user-breakable joint of a food-retaining portion to allow separation of the separable joint(s). Breaking of the joint(s) allows a user to bend the food-supporting member downward and away from food supported to facilitate the eating experience. The apparatus accommodates a variety of shapes and optionally includes a fold-over tab to assist a user in securing food beneath the tab and above the food-supporting member.

6 Claims, 6 Drawing Sheets

FOOD SERVING APPARATUS

CROSS-REFERENCE TO RELATED APPLICATIONS

This application claims benefit to Provisional Application Ser. No. 60/289,730 filed on May 10, 2001.

FIELD OF THE INVENTION

The present invention pertains to the field of food serving apparatus and more particularly to a food serving apparatus preferably formed of a single contiguous material in a manner having sufficient rigidity and shape to provide alignment of, and support of, one or more items of food, and having one or more apparatus segment portions that can be selectively folded away from the supported food item(s) in a manner not requiring the folding, or altering of the normal appearance, of the food item(s), and that can be done so, during the eating of the food to improve the eating experience.

BACKGROUND OF THE INVENTION

In the food service industry, including restaurants, cafeterias, cafes, pizzerias, and the like it is customary to provide customers with food served on some kind of plate or tray. Typically, such plates or trays are made out of a paper or plastic material that is preferably rigid enough to support the item of food being served. With certain types of foods it would be advantageous to have plates or trays that, in addition to being rigid enough to support the weight of served food, could also be selectively bent by the customer to improve the ease of eating the served food. To some degree, efforts along these lines have been attempted, but the results have been unsatisfactory.

For the purpose of describing the present invention, the food serving apparatus will be shown as a pizza slice plate or tray, however it is to be noted that the utility of the proposed invention is applicable to numerous types of foods each of which, can be served on trays or plates having similar features and functionality.

Conventionally, a slice of pizza is typically served on a plate or tray. The pizza must then be picked up from the plate to be eaten. The handling of such foods can quickly make one's hands greasy and many establishments serving pizza provide a stack of napkins to compensate for this problem. If there is an abundance of cheese, sauce, or other ingredients, the pizza can bend from its own weight and tend to come apart, making the eating process a much messier one than is necessary.

To address such problems several food-serving products have been tried. For example, numerous pizza slice-shaped plates and trays have been used. One approach has provided a type of flat pizza tray which is sized approximately to the length, width and shape of a pizza slice that is meant to be served on the tray. The flat planar tray is made out of a corrugated cardboard having corrugated flutes that run perpendicular to the length of a pizza slice resting on the tray. At various points along the length of the tray, a reduced cross-section, or score, parallel to the flutes, is formed into the tray to allow the customer to bend a tray in segments. Beginning nearest to the tip of the pizza, the customer bends each segment downward and away from the pizza slice as the pizza is being eaten. While the bending aspect of this approach offers a promising feature, the planar-tray approach has several shortcomings. First, several types of pizza are heavy for their size and the weight of such pizza can easily cause the tray to inadvertently collapse along its length which, either spills the pizza from the tray, or causes pizza ingredients to spill off of the pizza slice. To counter the lack of sufficient rigidity, trays can be made thicker, but the added material (e.g. thicker paper, plastic or corrugated material) adds to the cost of the tray. Another problem with the flat tray approach is that the trays are typically so closely sized to a pizza slice being served on them that it is quite easy for the pizza slice to become misaligned on the flat tray and when the tray is set down, for the pizza to contact surfaces, such as public surfaces, that are unsanitary. Such trays can also be set down on furniture, for example in a customer's home, or on a car seat, and the misaligned pizza can contact such surfaces causing unnecessary stains, or messes. Also, the planar pizza slice tray approach does not lend itself to a convenient self-containment of pizza slices, for example to fold into the shape of a box suitable for transporting a pizza slice from a pizzeria to another location.

Alternatively, some food serving trays and plates being offered, have a food-supporting member with upward extending side rails which facilitate the retention of an item of food on the food-supporting member. The design of such trays and plates are effective in keeping one or more food item from sliding off, or from becoming misaligned, however, none of them offer the means to selectively bend the trays or plates, or segments thereof, away from the served food while eating; or to maintain tray or plate rigidity until such time when a bending of the food-serving apparatus is desired. Such plates or trays still require a user to lift the pizza out of the food serving apparatus in order to eat the food. Another similar looking apparatus is comprised of a plurality of materials and requires a user to physically collapse the pizza upon itself, along its length, such that the pizza is fully enclosed within the food serving apparatus and segments of the plate are then selectively torn away from the folded food to expose portions thereof that can be bitten. This approach completely alters the normal appearance of the food and is leaves the user, when the slice of pizza has been consumed, with a plate that has literally been torn to pieces. The numerous plate pieces are quite likely to be coated with pizza sauce and/or other pizza ingredients and each will need to be picked up by the user in order to not pose a litter problem. If the user eats several slices of pizza, then the problems of the remaining plate pieces multiplies. Consequently, there is a need for improved food-serving apparatus that address the shortcomings of the status quo.

The purpose of the present invention is to provide improved food-serving apparatus which eliminate the deficiencies of the methods mentioned above and that offers a number of distinct advantages.

Therefore several objects of the invention are provided, which will:

- Provide serving trays or plates having sufficient rigidity to serve and support one or more items of food until a time when a user can selectively bend segment(s) of a food-serving apparatus away from the served food to facilitate the eating of the food and can do in a manner that does not alter the normal appearance of the food.
- Provide serving trays or plates having sufficient rigidity to serve and support one or more items of food until a time when a user wishes to selectively separate one or more separable joint which allows a corresponding segment of a food-serving apparatus to be bent away from the served food to facilitate the eating of the food.

Provide food-serving trays or plates offering improved protection from unsanitary public or domestic surfaces when the trays or plates are set down on such surfaces.

Provide economical food serving apparatus preferably made of a single contiguous material having a price comparable to other apparatus designed to serve the same food.

SUMMARY OF THE INVENTION

The present invention is a food serving apparatus preferably formed of a single contiguous material in a manner having sufficient rigidity and shape to provide alignment of, and support of, one or more items of food, and having one or more apparatus segment portions that can be selectively folded away from the supported food item(s) in a manner not requiring the folding, or altering of the normal appearance, of the food item(s), and that can be done so, during the eating of the food to improve the eating experience. The food serving apparatus has a food-supporting member sized, and having sufficient rigidity, to support and serve an item of food thereon. The apparatus can be made of material that is: re-cycleable; has grease-absorbing properties; or, has a food-supporting side having exposed corrugated flutes. The food-supporting member has at least one food-retaining portion integrally formed adjacent thereto which, extends upward, relative to a food-supporting surface of the food-supporting member, in a manner which increases the rigidity of the food-supporting member. The food-retaining portion (s) is sized, having sufficient rigidity, to facilitate the retention, or alignment, of an item of food on the food-supporting member. The food-retaining portion(s) may be made having a height that is sufficient for forming a part of a self-contained containment device such as an attachable lid. The food-supporting member of the apparatus has at least one bendable cross-section extending across the food-supporting member. At least one reduced-cross-section joint extends across the food-retaining portion and is located tangent to a bendable cross-section end to allow bending of the apparatus when the reduced cross-section joint is separated. The bendable cross-section(s) are made pre-disposed to bend by employing in any one or more of a variety of known manufacturing, product-forming, fabricating, or die methods, including, but not limited to, techniques that score, stamp, compress, emboss, partially cut, form, or perforate, such cross-sections. Similarly, the reduced-cross-section joint(s) are made pre-disposed to separate, by employing one or more of the aforementioned manufacturing techniques.

DESCRIPTION OF PRIOR ART

Search of U.S. and foreign patents has not revealed food serving apparatus having one or more user-selectable bendable cross-sections extending across a food-supporting surface of the apparatus that is reinforced by at least one adjacent jointed food-retaining portion extending perpendicularly therefrom in a manner which, increases the rigidity of the apparatus and prevents the bending of a bendable cross-section(s) unit:

such that the user may subsequently bend a segment of the food-serving apparatus, at the cross-section(s) tangent to the separated joint, away from the served food to facilitate the eating of the food.

The patent searching also found no food serving apparatus that accomplished the above-mentioned functionality while retaining the normal appearance of the food, i.e. without having to collapse, or fold, the food item upon itself.

U.S. Pat. No. 6,299,918 describes a pizza server that collapses, or folds, the pizza within a food serving apparatus having a lengthwise crease which predisposes the device to bend along its length so that it can encase the folded pizza within the apparatus so that the pizza slice will not flop. The food server has a plurality of parts whereby the lengthwise crease is separated by use of a pull string or perforation and tin strips embedded in the plate. The Morgese patent describes a fold over flap that allows the user to pinch the crust of the pizza beneath the flap, but it is noted that this feature is taught in prior art predating the filing date of Morgese's patent. Similarly, the Morgese patent describes indicia being included on his device, however the printing of indicia, including promotional subject matter on food serving plates has been practiced for many years and is widely known. It is also noted that there are numerous types of popular foods that would not lend themselves to being bent along their length, now would a user find it desirable to collapse their food in such a manner, in which case, the utility of the Morgese patent would not be desirable.

European patent WO-09700040 shows a flat food serving tray having a number of scores to allow the tray to bent. However, it was observed that when the trays were used by customers in Europe, that the trays were often set down on unsanitary public surfaces and there was insufficient means for keeping pizza from becoming misaligned on the trays. If such trays were used in one's home such misalignment could be the cause of furniture stains and other messes, particularly when used by children. Upward extending adjacent side panels were not added to the side edges of the tray to align the pizza, because the panels, and length thereof, would prevent the bending advantage of the tray. Consequently, the WO-09700040 patent is not able to sufficiently align and support, a slice of pizza in a manner that would be considered sanitary or sufficiently clean.

U.S. Pat. Nos. 5,476,214 and 5,129,521 respectively, show pizza serving trays that are nearly the same size as pizza that is meant to be served on the trays, having no food alignment or food retaining means, and consequently would suffer from food misalignment disadvantages such as food exposure to unsanitary surfaces and to home furnishings, automobile seats, and the like.

None of the cited prior art provides for a convenient way to incorporate the serving tray into a containment means, or box, suitable for transporting a slice of pizza from one place to another.

Consequently, the prior art patents are deficient in design and function and an improved food serving apparatus having a supported-until-torn segment-bending function, and an intermitting food containment or boxing method, is needed.

BRIEF DESCRIPTION OF THE DRAWINGS

FIG. 5 is semi-circular in shape to serve a taco, pita sandwich or calzone, FIG. 6 is elongated in shape to serve an elongated food item such as a hotdog, shish-kabob, burrito, tamale, or chicken leg, and FIG. 7 is sandwich-shaped to serve a hamburger, or sandwich, and the like.

DESCRIPTION OF THE PREFERRED EMBODIMENTS

Figure 8A:
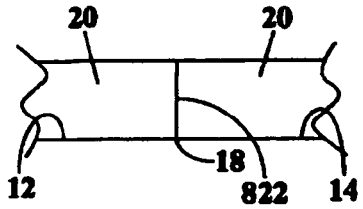
In FIGS. 8A through 8L, close-up side views of a variety of food-retaining portions are shown, each having a bendable joint, or a separable joint
Figure 8B:
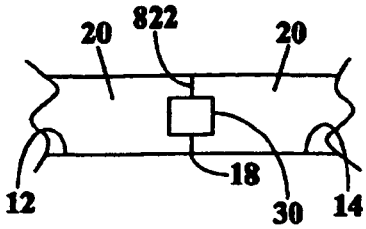
Figure 8C:
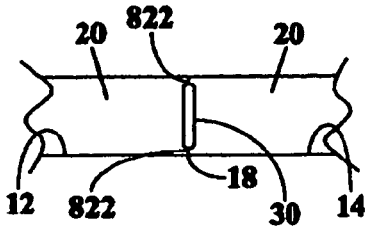
Figure 8D:
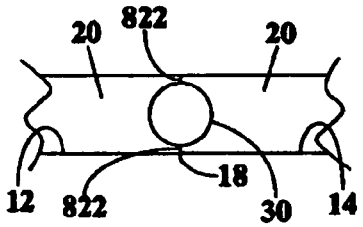
Figure 8E:
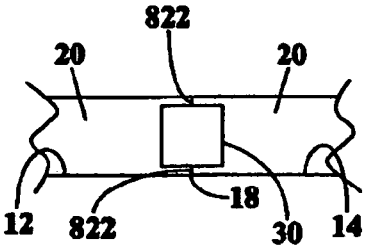
Figure 8F:
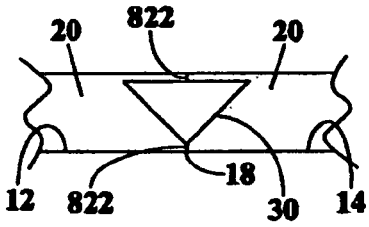
Figure 8G:
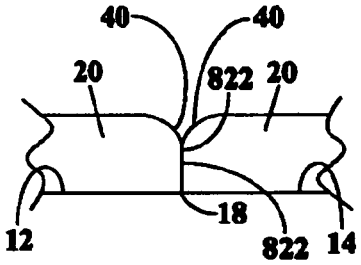
Figure 8H:
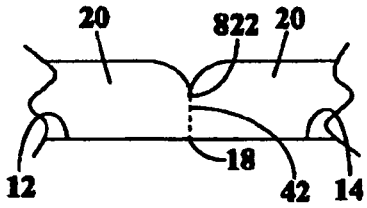
Figure 8I:
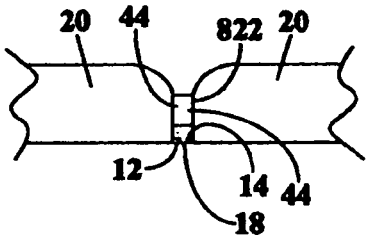
Figure 8J:
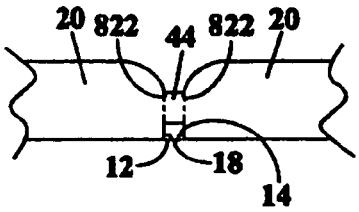
Figure 8K:
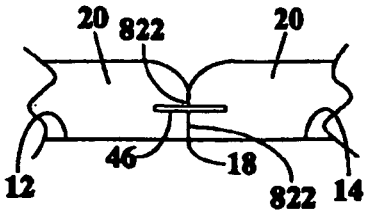
Figure 8L:
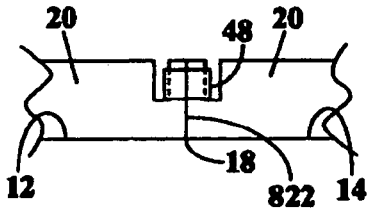
Figure 9:
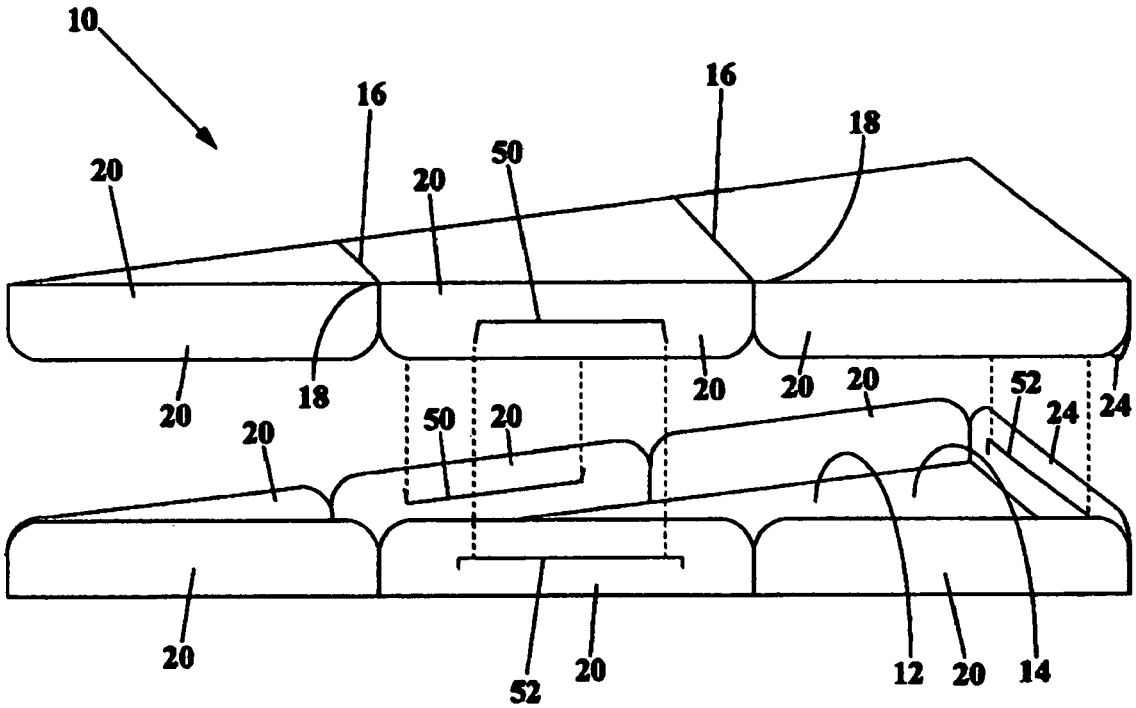
FIGS. 9 and 10 illustrate three-dimensional views of an interlocking relationship of opposing food-retaining portions of two food serving apparatus and how a containment means, or box, can be easily assembled to transport one or more food item from one place to another.
Figure 10:
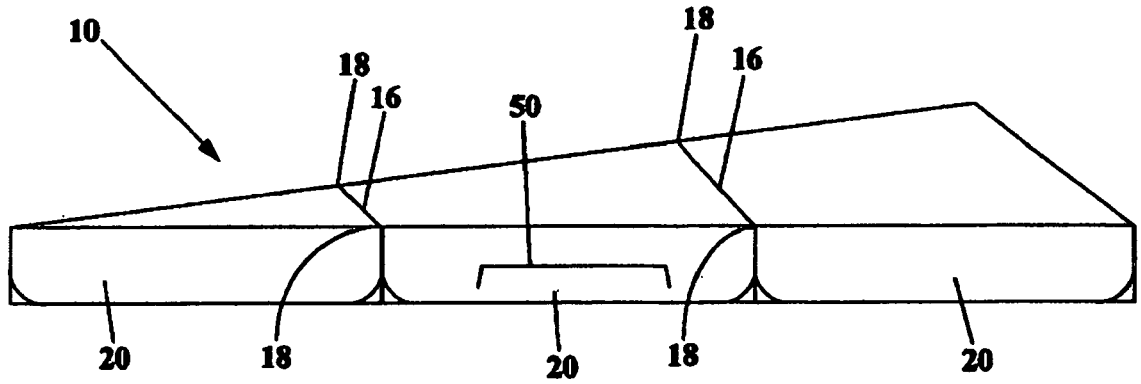

In reference to FIGS. 1A through 7 and FIGS. 9 and 10, a food-serving apparatus 10 is shown comprising a food-supporting member 12 consisting of a material sized, and having sufficient rigidity, to support, align and serve an item of food 34 (shown in the dashed lines). The apparatus can be made of material that is: recycleable; has grease-absorbing properties; or, has a food-supporting side having exposed corrugated flutes. The food-supporting member 12 has at least one food-retaining portion 20 integrally formed adjacent thereto which, extends upward, or can be bent upwards by a user, relative to a food-supporting surface 14 of said member, in a manner which increases the rigidity of the food-supporting member. The portion(s) 20 is sized, having sufficient rigidity, to facilitate the alignment and/or retention of an item of food 34 on the food-supporting member. Portions 20 may be made having a height that is sufficient for facilitating the creating of a containment device as seen in FIGS. 9 and 10. The apparatus 10 food-supporting member 12 has at least one bendable cross-section 16 extending across the food-supporting member. At least one reduced-cross-section joint (122, 222, 322, 422, 522, 622, 722, and 822 in the embodiment of FIGS. 1, 2, 3, 4, 5, 6, 7 and 8 respectively) extends across food-retaining portion 20 having a joint end tangent to a bendable cross-section end 18 to allow bending of the apparatus 10 at cross-section 16. The bendable cross-section(s) 16 and the reduced-cross-section (s) of joint 122, are made pre-disposed to bend and separate, respectively, by employing in any one or more of a variety of known manufacturing, product-forming, fabricating, or die methods, including, but not limited to, techniques that score, stamp, compress, emboss, partially cut, perforate, form, or inject, such cross-sections.

Figure 1A:
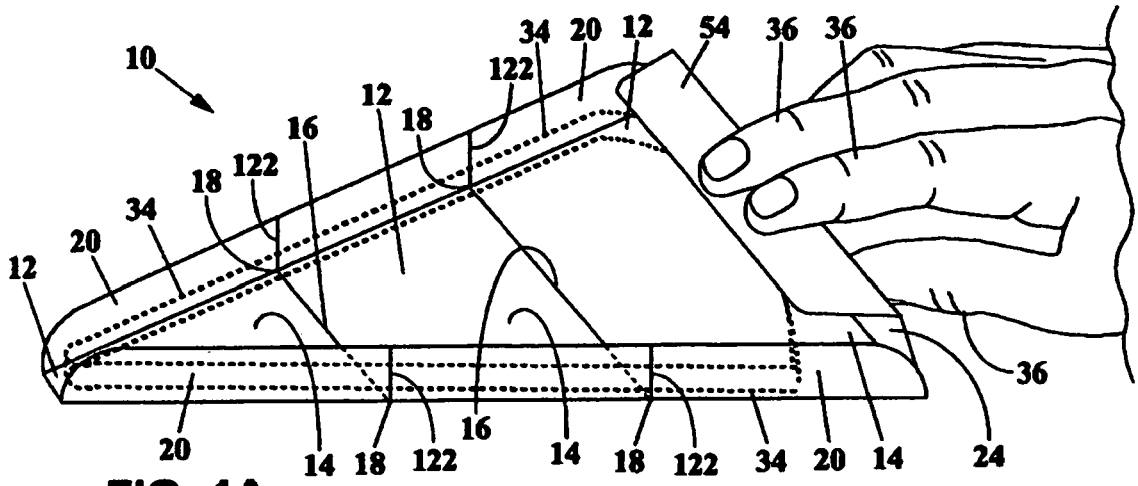
FIGS. 1A through 1C, and 2A through 2C are three-dimensional views of a food serving apparatus having bendable cross-sections shown between a plurality of segments. The letters "A", "B", "C" added to the figure numbers represent a sequence wherein the apparatus is unbent in letter "A"; an end segment is bent downward in letter "B"; and, a center segment and end segment is bent downward in letter "C". The dashed lines in FIGS. 1A, and 2A simulate an adjacent to the user-breakable joints depict an extension of the bendable cross-sections seen in 1B, 1C, 2B, and 2C. The apparatus is shown having food-retaining portions integrally formed adjacent thereto which, extend upward, relative to a food-supporting surface of the apparatus, in a manner which increases the rigidity of the food-supporting member. The food-retaining portions have separable joints extending tangent from each bendable cross-section.
Figure 1B:
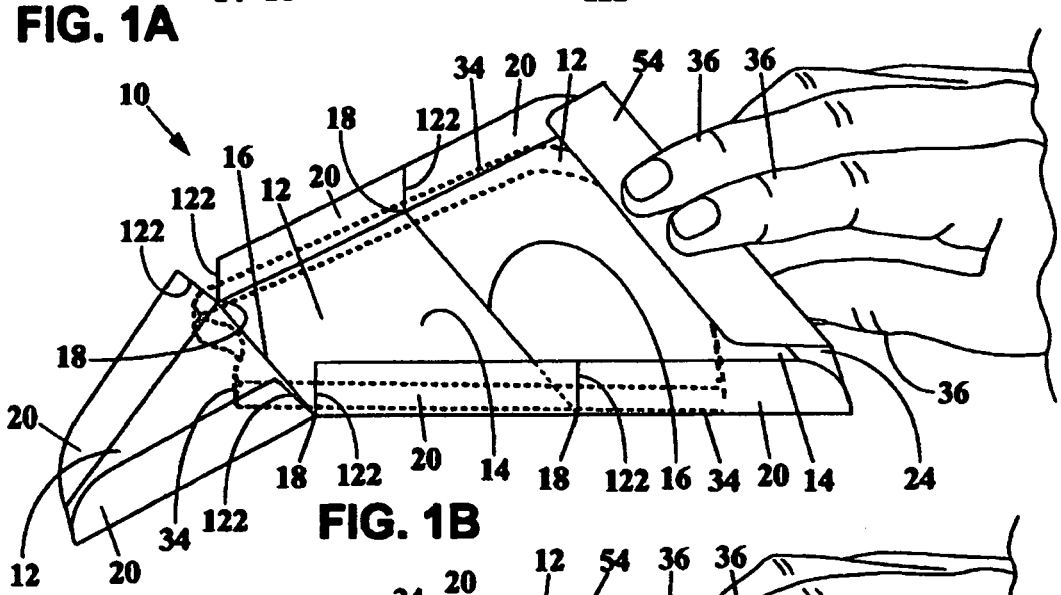
Figure 1C:
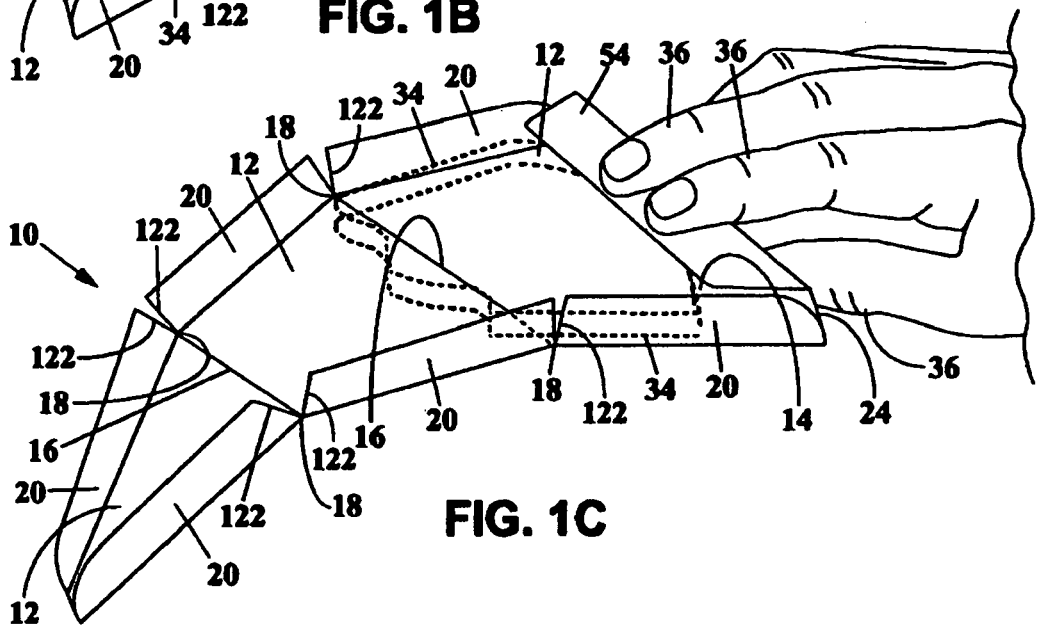
Figure 2A:
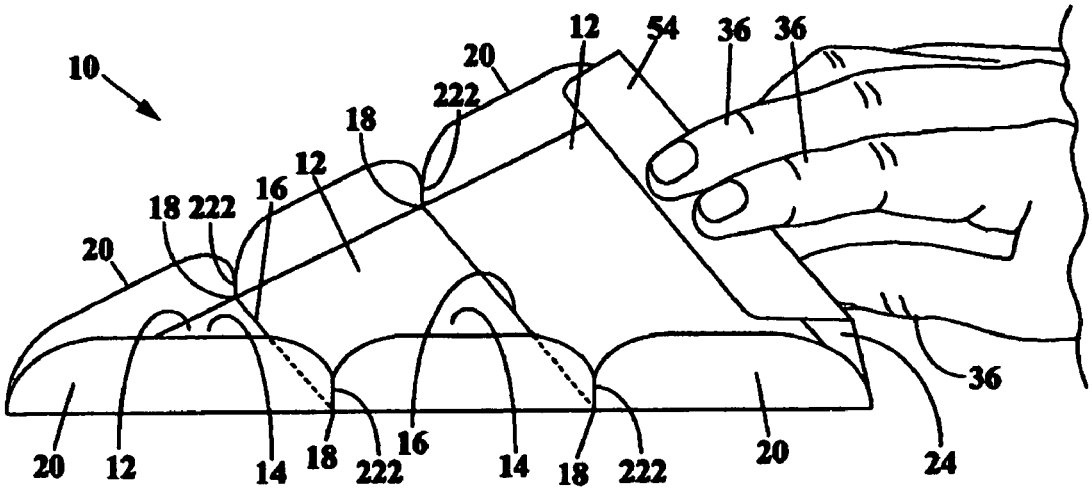
Figure 2B:
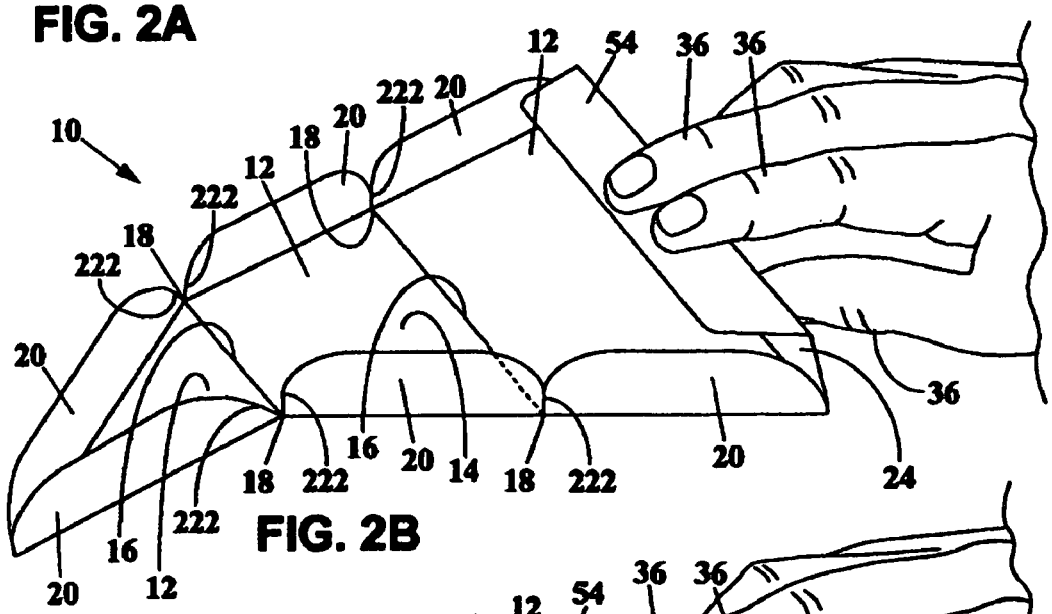
Figure 2C:
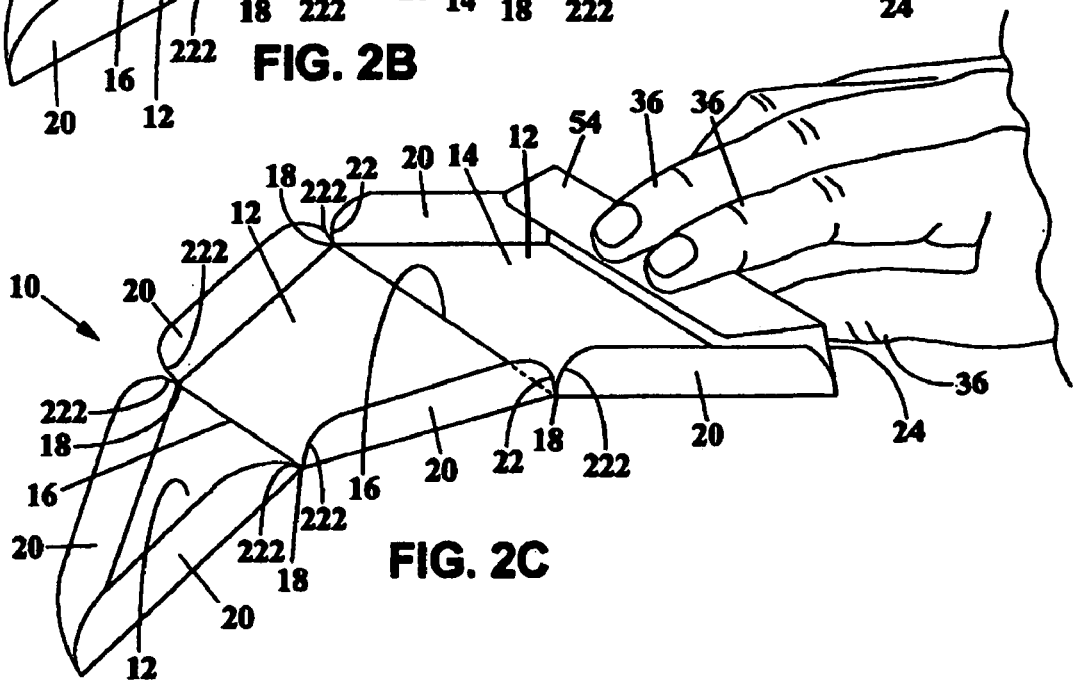

It is also noted that a rear food-retaining portion 24 can have a food-securing tab 54 that is secured to, or integrally formed extending from, an upper edge of portion 24, as seen in FIGS. 1A through 1C, and is operable by one or more digits 36 of a hand to secure an item of food beneath a lower edge of tab 54 and above a food-supporting surface 14 of an apparatus 10.

In each case, separation of at least one reduced-cross-section joint joint at the end of a respective bendable cross-section 16, allows a user to bend a segment of said food-supporting member 12 downward and away from food supported on the food-supporting member, to facilitate eating.

In FIGS. 8A through 8L, a close-up side view of a variety of food-retaining portions 20 is shown, each having at least one reduced-cross-section joint 822 which, is separable. It is noted that any in a variety of separable joints are possible with the present invention including, but not limited to those illustrated in the figure drawings. In each of the illustrations of FIGS. 8A through 8L, joint 822 is made separable such that the food-retaining portions 20 of the food serving apparatus 10 can easily be torn or separated to the cross-section end 18 to facilitate the bending of a bendable cross-section 16 which in turn, allows a food-supporting member 12 to be moved downward relative to a food-supporting surface 14. Optionally joint 822 may be comprised of a reduced cross-section joint 26 such as a scored, stamped, embossed, partially cut, formed, or perforated seam. It is to be noted that although most of the drawings illustrate an apparatus 10 having just two bendable cross-sections 16, that any of the apparatus can instead be made with one, a plurality, or numerous, bendable cross-sections. Additionally, it is also to be noted that bendable cross-sections 16 can also be made having a reduced-cross-section (for example a score) and/or perforated seam, which is made separable to allow for the removal, or tearing away, of one or more apparatus segment.

In reference to FIGS. 8A through 8L, FIG. 8A shows some of the sides of two food-retaining portions 20 extending upward relative to a food-supporting member 12 and a food-supporting surface 14 such that a separation of joint 822 to bendable cross-section end 18 will allow member 12 to be moved downward relative to surface 14, and relative to one or more food items extending beyond surface 14. A similar arrangement is shown in FIGS. 8B through 8L wherein, joint 822 is held together by any one or more of a variety of means including adhesive material(s), slip-fit, or glued-on material(s).

FIGS. 8B through 8F each illustrate a reduced-cross-section joint 822 comprising a shaped aperture 30 wherein: in FIG. 8C the aperture 30 is an oval shape, in FIG. 8D the aperture 30 is a circular shape, in FIG. 8E the aperture 30 is a rectangular shape, in FIG. 8F the aperture 30 is a triangular-shape. It is to be noted that although such shapes are explicitly shown, that a reduced-cross-section joint 822 can instead be comprised of any one or more in a variety of different shapes, and preferably are shaped such that when joint 822 is separated, the ends of food-retaining portions 20 are contoured so as to minimize any discomfort due to sharp corners and the like. For example, in FIGS. 8G through 8K, the upper end contours of adjacent food-retaining portions 20 have a rounded contour 40 (shown in FIG. 8G). Optionally any joint 822 may be comprised of a alternative type of reduced cross-section joint. In FIG. 8H, the reduced cross-section of joint 822 is perforated between the two portions 20 and can be separated by a user tearing the perforated seam 42. In FIG. 8I, joint 822 between portions 20 can be separated by a user tearing, or breaking away, an attachment member 44, wherein member 42 is comprised of a material, or is of a reduced size, that is easier to tear, or break, than the portions 20 material, and can be colored and/or having a different appearance, or texture, than portions 20. In FIG. 8J, joint 822 between portions 20 can be separated by a user tearing, or breaking away, one or more edge of an attachment member 44, wherein member 42 is preferably comprised of the same material as food-retaining portions 20 but has a reduced height relative to the height of portions 20, and preferably has one or both of its edges perforated. In FIG. 8K, two food-retaining portions 20 are shown being secured to one another by suitable fastening means 46 such as a staple. It is to be noted that any one or more of a variety of common fastening means may instead be employed to temporarily secure portions 20 together and preferably are shaped such that when joint 822 is separated, the ends of food-retaining portions 20 are contoured so as to minimize any potential discomfort due to sharp corners and the like. In FIG. 8L, portions 20 are shown having cut-outs to allow a temporary slip-fit, or snug-fit collar 48, or band, which holds together a pre-cut joint 822, or a reduced cross-section joint 26, or other type of joint previously described.

Figure 3:
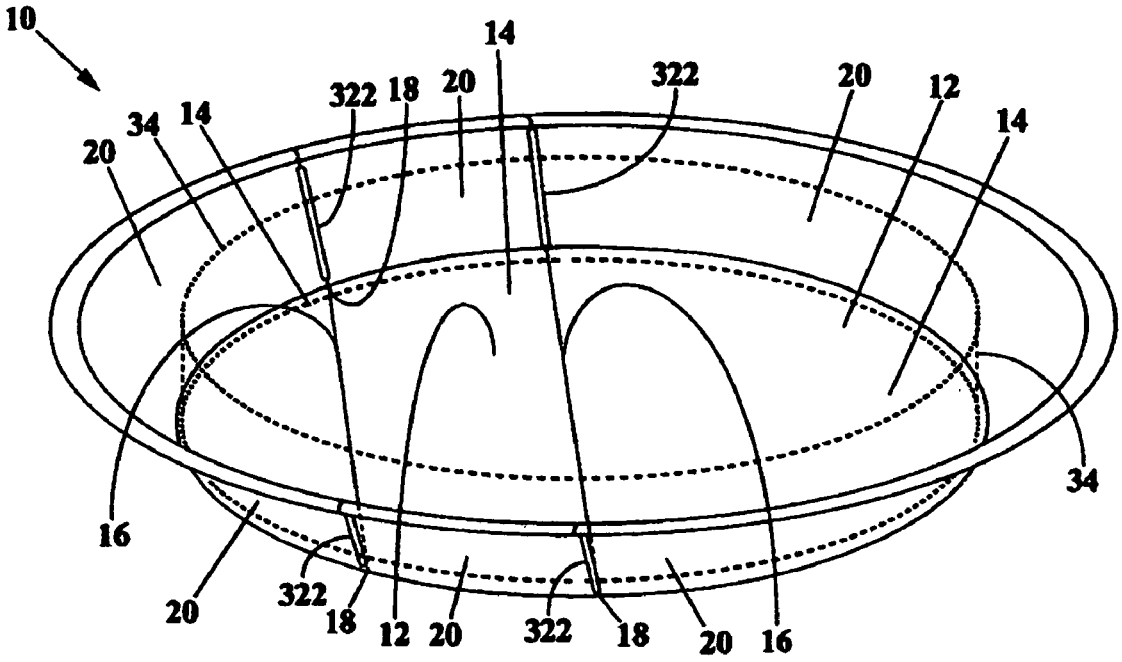
FIGS. 3 and 4 show a three-dimensional view of a food serving apparatus similar to FIGS. 1 and 2, and the separable joints thereof, but instead have a contiguously-formed three-dimensional shape, wherein apparatus 10 is generally round-shaped, or plate-shaped in FIG. 3, and is generally triangular-shaped in FIG. 4.
Figure 4:
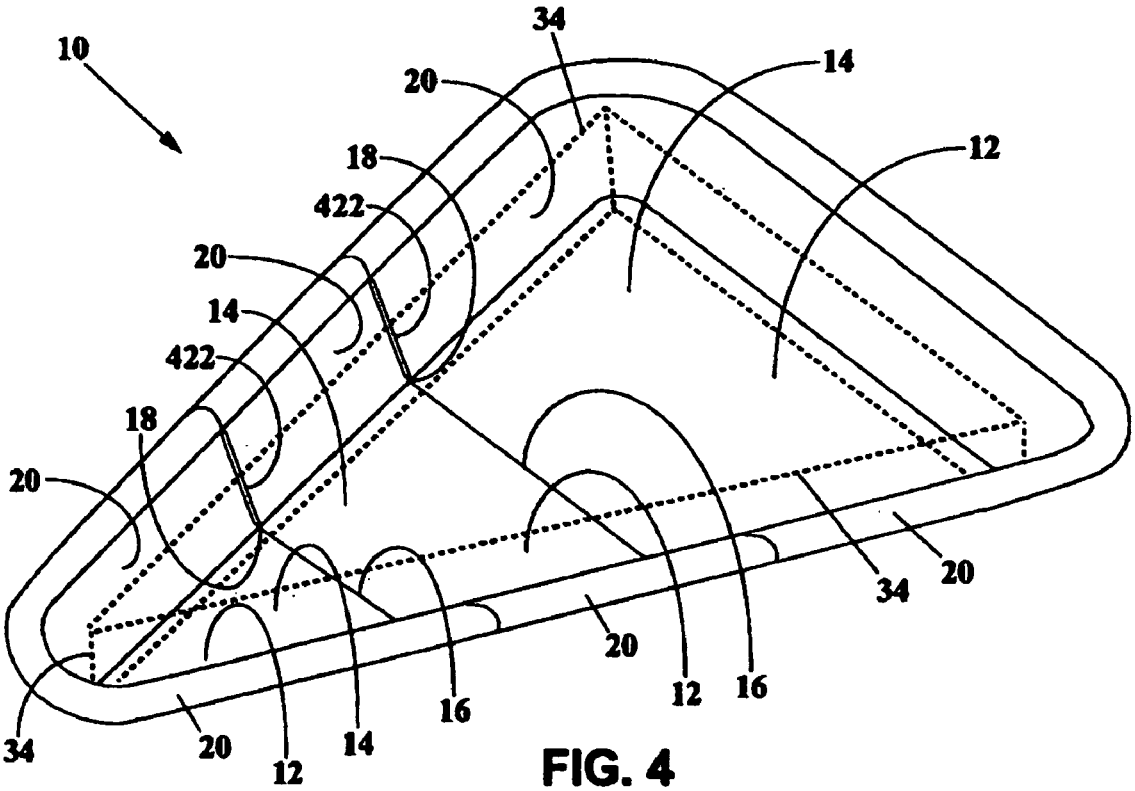

FIGS. 3 and 4 show a three-dimensional view of a food serving apparatus similar in function to figures and 2, and the bendable segments and separable joints thereof, but instead have a contiguously-formed three-dimensional shape, wherein apparatus 10 is generally round-shaped, or plate-shaped in FIG. 3, and is generally triangular-shaped in FIG. 4. When the apparatus is triangular in shape it can accommodate the serving of food selected from the group consisting of pizza slices, pie slices, at least one dessert item, candy, and quiches. It is to be noted that apparatus 10 can have any in a variety of die-cut, and/or three-dimensional shapes that are substantially, contiguously formed. Irrespective of how the apparatus is made numerous apparatus shapes are possible including, but are not limited to, apparatus that are generally: round, oval, triangular, rectangular, or asymmetrical. The food-supporting member 12 of the apparatus 10 has at least one food-retaining portion 20 integrally formed adjacent thereto which, extends upward, relative to a food-supporting surface 14 of said member, in a manner which increases the rigidity of the food-supporting member. The portion(s) 20 is sized, having sufficient rigidity, to facilitate the alignment and/or retention of an item of food on the food-supporting member. The food-supporting member 12 has at least one bendable cross-section 16 extending across the food-supporting member. At least one reduced-cross-section joint, such as any of those previously described, extends across the food-retaining portion 20 and is located tangent to a bendable cross-section end 18 to allow bending of the apparatus 10 at cross-section 16. The bendable cross-section(s) 16 and the reduced-cross-section(s) of the joint(s), are made predisposed pre-disposed to bend and separate respectively, by employing in any one or more of a variety of known manufacturing, product-forming, fabricating, or die methods, such as those previously described. In operation, a user selectively tears, or breaks, the joint(s) tangent to a reduced-cross-section end 18 nearest to the end of a food item the user wishes to consume. The tearing, or breaking, of joint(s) allow an adjacent bendable cross-section 16 to bend, and the user can conveniently repeat this step sequentially until the item of food is consumed. If the user wishes to pause during eating, any of the apparatus of the present invention, can be set down flat on a public surface, or on surfaces within one's home, or vehicle, and the apparatus will temporarily resume its unbent, original shape, and protect the food from contact with unsanitary surfaces, and will facilitate retention of the food item(s) on the apparatus.

Figure 5:
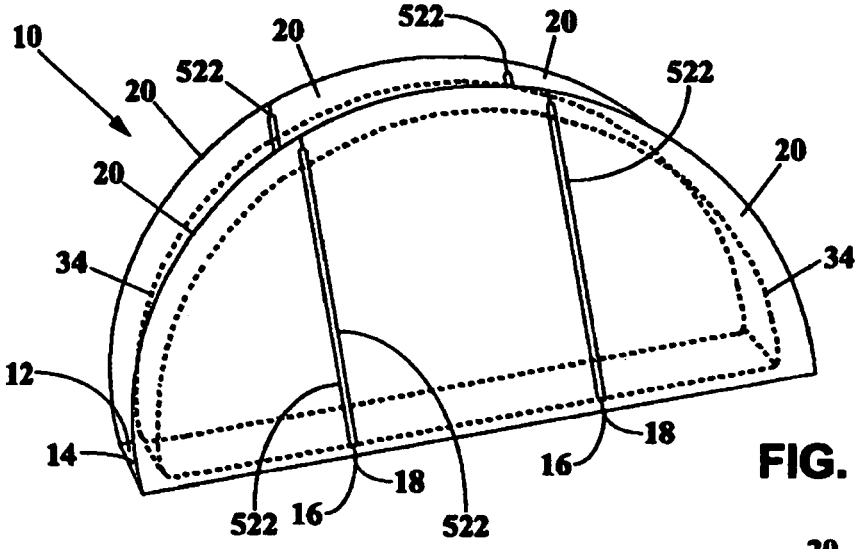
FIGS. 5, 6 and 7 are three-dimensional views of food serving apparatus similar to the previous figures and their separable joints, but instead each has a shape to accommodate a particular type of food item. Namely.
Figure 6:
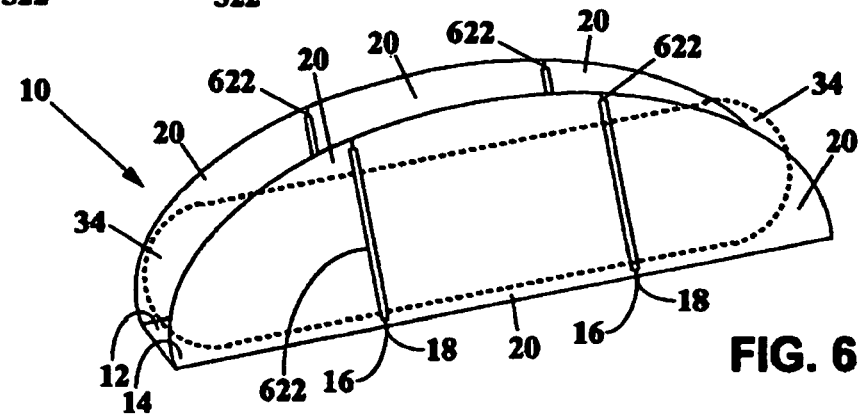
Figure 7:
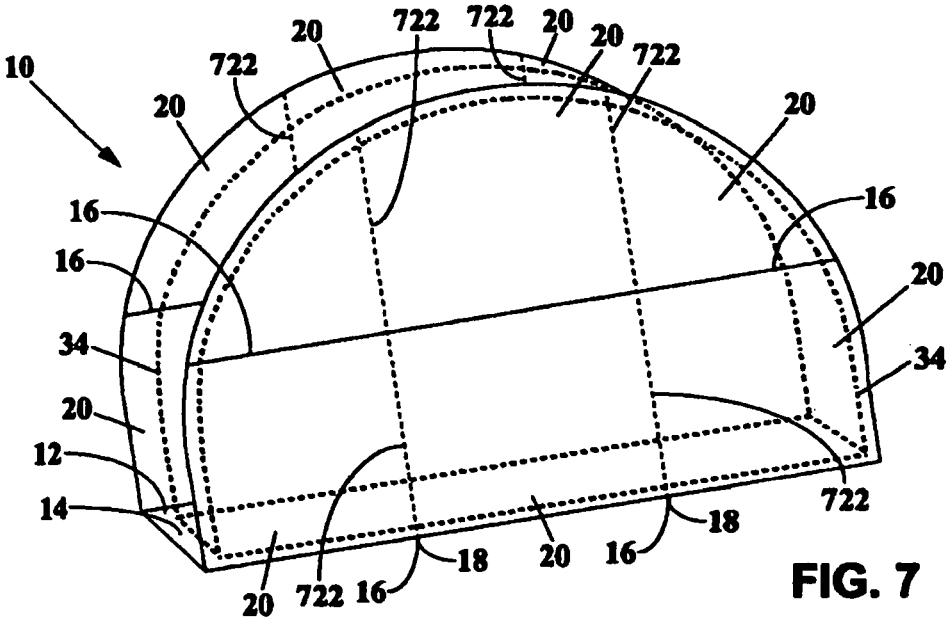

In reference to FIGS. 5, 6 and 7, three-dimensional views of food serving apparatus 10 are depicted that are similar in structure and operation to the previous figures and the bendable segments and separable joints thereof, but instead each has a shape to accommodate a particular type of food item. Namely, FIG. 5 is semi-circular in shape (or profile) to accommodate the serving of food selected from the group consisting of tacos, calzones or pita sandwiches, and the like, FIG. 6 is elongated in shape to accommodate the serving of food selected from the group consisting of hotdogs, shish-kabobs, burritos, tamales, and poultry legs, and the like, and FIG. 7 is sandwich-shaped to accommodate the serving of food selected from the group consisting hamburgers, or sandwiches, or the like. FIG. 7 illustrates how any of apparatus 10 can optionally have a plurality of bendable cross-sections 16 and/or separable joints 722 including on upward extending sides thereof.

FIGS. 9 and 10 illustrate three-dimensional views of an interlocking relationship of opposing food-retaining portions 20 of two food serving apparatus 10 and how a containment means, or box, can be easily assembled to transport one or more food item from one place to another. Thus, a food serving apparatus 10 in the form of a fast food serving and containing device is provided. The device is comprised of a thin wall structure erected from a sufficiently rigid material such as paperboard blank, or formed of a bendable plastic material. In this embodiment of the present invention the apparatus can be conveniently stored or stacked in a nested relationship with a multiplicity of similar thin wall structures and subsequently formed as needed, into a closed container such that fast food or the like can be contained and transported therein. The containing device can be easily opened by a user from the closed container defining position back into a tray defining position wherein the same can be used in serving the fast food or the like contained therein. The conversion between the tray defining position and the closed container defining position is facilitated by the interlocking relationship of opposing food-retaining portions 20 of two food serving apparatus 10. Although the apparatus is shown having one or more interlocking tab(s) 50 that is sized to slide into a tab-receiving slot 52, it is to be noted that any one or more of a variety of common interlocking methods or apparatus can instead be employed and the advantages and objects of the present invention pertaining to its containment utility and its bending during the eating of an item of food, are also achieved. The dashed lines in FIG. 9 show the alignment of tab-receiving slots 52 that positioned beneath the interlocking tab(s) 50. FIG. 9 also shows a rear food-retaining portion 24 having an optional interlocking tab means that can be employed in a container embodiment of the present invention.

In operation, an item of food is placed in one food-serving apparatus 10, and an inverted second apparatus 10, or apparatus-shaped lid with interlocking means, is aligned over the first apparatus, such that one or more interlocking means of the upper apparatus can be aligned with, and securely interfit with, respective, receiving interlocking means of the first apparatus. When the user desires, the interlocking means of the two apparatus can be quickly and easily separated to provide easy access to the food item.

It is also noted that a rear food-retaining portion 24 can have a food-securing tab 54 that is secured to and extends from an upper edge of portion 24, as seen in FIGS. 1A through 1C, and is operable by one or more digits 36 of a hand to secure an item of food beneath a lower edge of tab 54 and above a food-supporting surface 14 of an apparatus 10.

Although the present invention has been described in connection with the preferred form of practicing it, many modifications can be made thereto within the scope of the claims that follow. Accordingly, it is not intended that the scope of the invention in any way be limited by the above description, but instead be determined entirely by reference to the claims that follow.

What is claimed is:

1. A user-foldable, food-serving apparatus comprising:

a food-supporting member made of a material sized and having sufficient rigidity to support the typical bottom area and the weight of at least one item of food-item when said apparatus is held at one end in a substantially horizontal orientation, and said food-supporting member having at least one foldable segment positionable by a user to facilitate eating and to prevent the served food from contacting unsanitary surfaces when said food-supporting member is placed in a flattened condition on a surface;

said food-supporting member having a plurality of side walls extending upward adjacent from outer edges of said food-supporting member in a manner which increases the rigidity of said food-supporting member, wherein said plurality of said side walls define an opening and have at least one reduced cross-section user-breakable joint, and said plurality of side walls are sized to surround a majority of the perimeter of said at least one food-item having sufficient rigidity to facilitate the retention of, said at least one food-item on the food-supporting member;

said plurality of side walls further comprising an upward extending rear wall having a food-securing tab foldably connected adjacent to and extending forward from an upper edge thereof, said tab having a width which spans a majority of the width of a served food and is operable by the digits of a hand to assist a user in securing food beneath the tab and above said food-supporting member in a manner which supports served food in a horizontal orientation, during the eating of said food by said user;

said food-supporting member having at least one bendable line extending across said food-supporting member;

said at least one user-breakable joint being located tangent to an end of said bendable line to allow a user to break said side walls at said at least one user-breakable joint, whereby the breaking of said at least one user-breakable joint allows a user to selectively bend said at least one segment of said food-supporting member downward and away from food supported on said food-supporting member to facilitate eating the food extending beyond the user folded said at least one-segment of the apparatus, and to selectively unfold previously folded said at least one segment to a generally flattened orientation preventing said at least one food-item from contacting unsanitary surfaces when the apparatus is placed in a resting position wherein the shape of said food-supporting member of said apparatus is triangular in shape.

2. The apparatus of claim 1 wherein said food-supporting member has a plurality of bendable lines to allow bending the apparatus into a plurality of segments.

3. The apparatus of claim 1 wherein the user-breakable joints of said side walls have a reduced cross-section further comprising at least one aperture.

4. The apparatus of claim 1 wherein said user-breakable joints of said side walls have a reduced cross-section further comprising at least one perforated seam.

5. The apparatus of claim 1 wherein said user-breakable joints of said side walls have a reduced cross-section and a fastening means.

6. A user-foldable, food-serving apparatus comprising:

a food-supporting member made of a material sized and having sufficient rigidity to support the typical bottom area and the weight of at least one item of food-item when said apparatus is held at one end in a substantially horizontal orientation, and said food-supporting member having at least one foldable segment positionable by a user to facilitate eating and to prevent the served food from contacting unsanitary surfaces when said food-supporting member is placed in a flattened condition on a surface;

said food-supporting member having a plurality of side walls extending upward adjacent from outer edges of said food-supporting member in a manner which increases the rigidity of said food-supporting member, wherein said plurality of said side walls define an opening and have at least one reduced cross-section and said plurality of side walls are sized to surround a majority of the perimeter of said at least one food-item having sufficient rigidity to facilitate the retention of, said at least one food-item on the food-supporting member;

said plurality of side walls further comprising an upward extending rear wall having a food-securing tab foldably connected adjacent to and extending forward from an upper edge thereof, said tab having a width which spans a majority of the width of a served food and is operable by the digits of a hand to assist a user in securing food beneath the tab and above said food-supporting member in a manner which supports served food in a horizontal orientation, during the eating of said food by said user;

said food-supporting member having at least one bendable line extending across said food-supporting member;

said at least one user-breakable joint being located tangent to an end of said bendable line further comprising at least one shaped aperture to facilitate a breaking of said side walls at said at least one user-breakable joint, whereby the breaking of said at least one user-breakable joint allows a user to selectively bend said at least one segment of said food-supporting member downward and away from food supported on said food-supporting member to facilitate eating the food extending beyond the user folded said at least one-segment of the apparatus, and to selectively unfold previously folded said at least one segment to a generally flattened orientation preventing said at least one food-item from contacting unsanitary surfaces when the apparatus is placed in a resting position wherein the shape of said food-supporting member of said apparatus is triangular in shape.

* * * * *